US005421738A

United States Patent [19]

Roberts

[11] Patent Number: 5,421,738

[45] Date of Patent: Jun. 6, 1995

[54] HIGH-DENSITY PRINTED CIRCUIT CONNECTOR WITH PIVOTABLE SPRING

[75] Inventor: Joseph A. Roberts, Grafton, N.H.

[73] Assignee: Miraco, Inc., Nashua, N.H.

[21] Appl. No.: 268,245

[22] Filed: Jun. 29, 1994

[51] Int. Cl.[6] ..... H01R 9/07

[52] U.S. Cl. ..... 439/260; 439/62; 439/67

[58] Field of Search ..... 439/59, 62, 65, 67, 439/329, 636–637, 839, 260–261

[56] References Cited

U.S. PATENT DOCUMENTS

| | | | |
|---|---|---|---|
| 3,407,379 | 10/1968 | Nakazawa et al. . | |
| 3,543,226 | 11/1970 | Laboue . | |
| 3,980,377 | 9/1976 | Oxley . | |
| 4,087,151 | 5/1978 | Robert et al. . | |
| 4,106,841 | 8/1978 | Vladic . | |
| 4,109,986 | 8/1978 | Mouissie . | |
| 4,534,610 | 8/1985 | Takihara | 439/839 |
| 4,815,979 | 3/1989 | Porter | 439/62 |
| 5,171,154 | 12/1992 | Casciotti et al. | 439/67 |
| 5,173,058 | 12/1992 | Broeksteeg et al. | 439/267 |
| 5,190,480 | 3/1993 | Chau et al. . | |
| 5,306,160 | 4/1994 | Roberts | 439/62 |
| 5,308,249 | 5/1994 | Renn et al. | 439/62 |
| 5,316,486 | 5/1994 | Tanaka et al. | 439/62 |

*Primary Examiner*—Larry I. Schwartz
*Assistant Examiner*—Jill DeMello
*Attorney, Agent, or Firm*—Davis, Bujold & Streck

[57] ABSTRACT

A connector for connecting conductor areas of a flexible circuit to contact pads of a PC board edge connector in which the connector pivotably supports a pair of springs which pivot to a first position, upon insertion of a PC board through the board opening of the connector, in which frictional engagement between the PC board edge connector and the conductor areas is minimized, and, a second position during final insertion of the PC board edge connector into the connector, in which the springs provide a sufficient contact pressure for adequate electrical contact between the conductors areas of the flexible circuit and the contact pads of the PC board edge connector. The pivotable arrangement of the springs minimizes the wear and tear of the internal components and the contact pads while ensuring adequate electrical connection between the interconnected components.

17 Claims, 4 Drawing Sheets

HIGH-DENSITY PRINTED CIRCUIT CONNECTOR WITH PIVOTABLE SPRING

This invention relates to a high-density printed circuit connector system. More particularly, though not exclusively, the invention relates to an improved connector for connecting contacts of a flexible circuit to conductive pads on a printed circuit board.

BACKGROUND OF THE INVENTION

In electrical systems, flexible printed circuits are employed as electrical jumpers or cables for interconnecting rows of terminal pins or pads of printed circuit boards. A connector, mounted to one or both ends of the jumper, has typically been formed with a set of electrical receptacles or sockets which are designed to receive the terminal posts or contact the pads on the printed circuit board.

In today's electronics market, manufacturers are placing emphasis on increasing their product's reliably and reducing assembly costs to remain competitive. A primary focus of each manufacturer is to reduce the cost and increase the circuit density associated with interconnecting the sub-assemblies and components found within its products. Another emerging focus in today's electronics market is to pack more electronic functions into smaller packages. This means higher density modules, each requiring multiple high density interconnections to other modules.

Connector manufacturers have not kept pace with today's market needs. Simply stated, conventional connector technology cannot accommodate todays high-density requirements. This is because existing connectors consist of individual stamped contacts assembled into a molded plastic housing. The physical size required to manufacture an acceptable spring contact eliminates this technology in high-density circuits. For the last 25 years electronic systems have been designed around conventional connector technology. Connector manufacturers have effectively led this market, and system designers gladly followed, because these connectors satisfied their needs. This cannot continue as significant events are combining to change the role of connectors forever, including a new generation of chips that will drive PC board manufacturers to produce boards with conductors on 0.30 mm (0.012 inch) or less on center. These boards must be interconnected to other modules or to the outside world and will require a high-density connector and interconnect cable.

These key events have led to development of the high-density connector system of the present invention.

SUMMARY OF THE INVENTION

It is an object of the present invention to provide a connector system for reliably and releasably connecting the conductive circuit paths of a flexible circuit to closely packed (high density) conductive pads of a PC board in a way that provides accurate registration to ensure reliable desired connection.

A further object is to provide a connector system which can be formed as an inexpensive structure, is relatively easy and inexpensive to make in quantity and can be mounted to the end of a flexible circuit without requiring an elaborate welding or soldering operation and which can be readily connected to and aligned with contact pads on the face of a printed circuit board.

One form of the present invention can accommodate at least 33 conductors per centimeter (approximately 84 conductors per inch with 42 conductors on each side of the PC board). This is at least twice the density of existing single row connector technology.

A still further object of the invention is to minimize frictional and contact wear of the connector components as the connector is interconnected with desired conductor pads of a printed circuit board.

Another object of the invention is to apply a light contact force during insertion of the conductive paths of the printed circuit board into the cavity of the connector to remove any oxides or foreign matter on the contact.

Still another object of the invention is to minimize the necessary force required to achieve the interconnection between the connector and a desired component during a major portion of the insertion stroke while maintaining the necessary contact force once the complete insertion has occurred.

Yet another object of the invention is to cantilever a spring within the connector so as to apply a predetermined force to a flexible circuit and accommodate varying thickness conductive paths of a printed circuit board once inserted therein. The cantilevered spring deflects as necessary to accommodate the thicker printed circuit board without permanent damage to the spring.

These and other objects of the invention will become apparent to one skilled in the art upon reading the following description in connection with the appended drawings.

According to the invention there is provided a connector for connecting electrical conductor areas of a flexible circuit with electrical conductor pads of a connector portion of a structure, said connector comprising a connector housing having a pivot bearing, a cavity, a spring located in said cavity by said pivot bearing for pivotal movement thereabout, and a flexible circuit, defining said conductor areas, positioned in said cavity to be urged by said spring into electrical contact with said conductor pads of said connector portion when inserted into said cavity; wherein said spring defines an electrical contact producing portion and is pivotable about said pivot bearing to urge said conductor areas into electrical contact with said conductor pads when said connector portion is accommodated in said cavity and a follower portion, remote from said contact producing portion, is disposed to be engaged by said connector portion upon its insertion thereof into said cavity to urge said spring about said pivot bearing to produce said electrical contact.

Also according to the invention there is provided a connector for reliably effecting desired electrically conductive contact between conductor areas of a flexible circuit with conductor pads of an edge connector portion of a circuit board, said connector comprising a) a connector housing defining a cavity to accommodate an edge connector portion of a desired circuit board, said housing having a first opening to allow said edge connector portion to access said cavity and a second opening to allow a flexible circuit to extend into said cavity of said connector housing; and b) spring means for resiliently biasing said electrical conductor areas into electrical contact with said conductor pads when said edge connector portion is accommodated in said cavity, said spring means being supported by and pivotal about a pivot means located in the cavity and defining an electrical contact producing portion moveable about said pivot means to urge said conductor areas into electrical contact with said conductor pads when said edge connector portion is accommodated in said cavity and a follower portion, remote from said contact producing portion and said first opening, disposed to be engaged by said edge connector portion upon insertion thereof into said cavity to urge said spring means about said pivot means to produce said electrical contact; wherein c) said spring means is pivotable about said pivot means so that said electrical contact producing portion of said spring means can pivot away from said edge connector portion as said edge connector portion enters said cavity through said first opening, and d) in achieving accommodation of said edge connector into said connector, said follower portion of said spring means engages said edge connector portion to urge said conductor areas into said desired electrical contact with said conductor pads.

Also according to the present there is provided a connector for connecting electrical conductor areas of a flexible circuit with conductor pads of an edge connector portion of a circuit board, said connector comprising a) a connector housing having a circuit board opening sized to at least partially accommodate a said edge connector portion, and said connector housing having a circuit opening allowing passage of two flexible circuits into an interior cavity of said connector housing; and b) two springs for resiliently biasing electrical conductor areas of an edge connector contacting region of a flexible circuit into electrical contact with said conductor pads, when said connector engages a said edge connector portion, each spring being pivotably supported via a pivot support formed in opposed surfaces of said connector housing; and c) each spring supporting a flexible circuit having conductor areas facing one another to provide electrical contact with said conductor pads of an edge connector portion when engaged therewith; wherein d) said two springs are freely pivotable about said pivot supports between first and second positions in the first of which longitudinal edges of said springs located adjacent said circuit board opening pivot away from one another, as said spring is pivoted to the first position, while opposite longitudinal edges of said springs, remotely located from said circuit board opening, pivot toward one another upon insertion of said edge connector portion into the interior cavity of said connector, the springs pivot away from one another and minimize frictional resistance between the conductor areas and the conductor pads and e) as said edge connector portion is fully inserted within the interior cavity, said springs provide, in the second position, suitable electrical contact pressure between the conductor areas and conductor pads.

Also according to the invention there is provided a method of manufacturing a connector for connecting electrical conductor areas of a flexible circuit with conductor pads of an edge connector portion of a circuit board, comprising the steps of providing a circuit board opening, sized to at least partially accommodate an edge connector portion of a desired circuit board, within a connector housing; providing at least a second opening within said connector housing for passage of a flexible circuit into an interior cavity of said connector housing; pivotably supporting a spring, for resiliently biasing electrical conductor areas in an edge connector contacting region of a flexible circuit, when supported therein, into electrical contact with said conductor pads when said connector is attached to a said edge connector portion, via a pivot support formed in an interior surface of said connector housing; said spring being freely pivotable about said pivot support between first and second positions in the first of which a longitudinal edge of said spring located adjacent said circuit board opening pivots toward the interior surface of said connector housing supporting said pivot support while a second opposite longitudinal edge of said spring located remoted said circuit board opening pivots away from the interior surface of said connector housing supporting said pivot support whereby said spring, upon insertion a said edge connector portion within the interior cavity of said connector, is pivoted to the first position and minimizes frictional resistance between the connector and a said edge connector portion and said spring and, when a said edge connector portion is fully inserted within the interior cavity, provides in the second position suitable electrical contact pressure between the conductor areas and conductor pads.

Advantages of the present form of the invention over know prior art are:

1. Ability to terminate at least 33 separate contacts per centimeter (approximately 84 separate contacts per inch).
2. Accurate registration of each contact cluster to a mating circuit pattern.
3. Compliant contact clusters and leaf spring construction which compensate for variations in board thickness.
4. Provision of a wiping contact.
6. Mechanical components which ensure long term reliability.
7. Stored energy contacts which offer reliable and predictable contact force.
8. Vibration resistance.
9. Planar contacts allowing controlled contact impedance.
10. Versatility with contacts being individually designed to accommodate specific electrical needs.

BRIEF DESCRIPTION OF THE DRAWINGS

The invention will now be described, by way of example, with reference to the accompanying drawings, in which.

DESCRIPTION OF THE PREFERRED EMBODIMENTS

Figure 10:
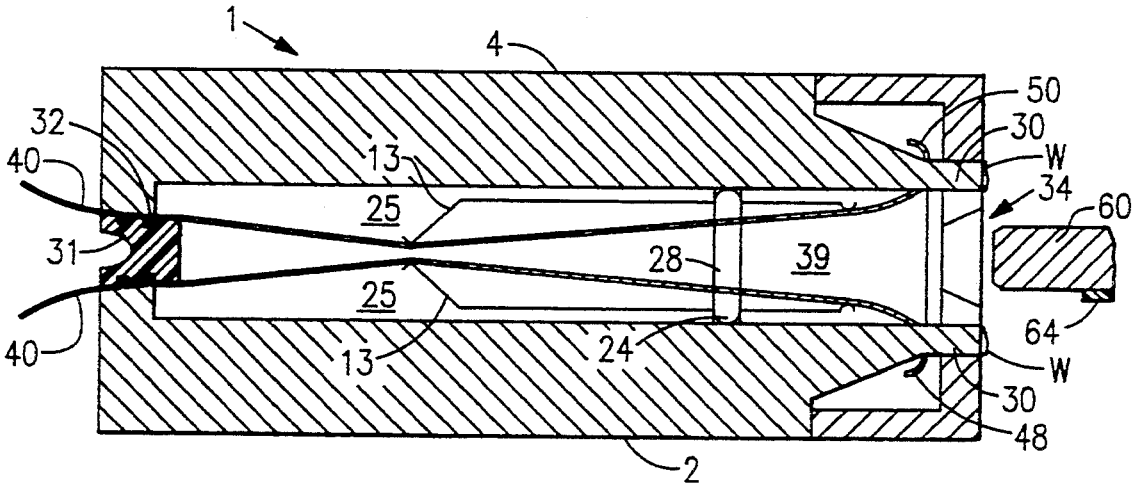
FIG. 10 is a diagrammatic cross-section showing the assembled components of the present invention.

With reference to FIGS. 1–10, in particular, FIG. 10, the connector 1 of the present invention typically comprises two mateable molded structures, namely a first 2 and a second 4 module, and an outer housing 6 configured to maintain the two modules 2, 4 in a desired fixed alignment and location relative to one another whereby the two modules and the outer housing form a unitary structure. As will be understood from the following description, the unitary structure may be simply assembled by connecting together the various components and ultrasonically welding or heat fusing W a portion of the interconnected components to one another (e.g. pins 30 to the outer housing; see FIG. 10) thereby to form a unitary structure.

It will be appreciated that the first 2 and second 4 modules are identical with one another and are assembled in mirror image of one another.

The unitary structure houses and maintains a desired alignment of two pivotably supported springs 8 (FIGS. 6 and 7) each defining a plurality of cantilever parallel leaf contact springs 10 adjacent one longitudinal edge thereof with the opposite longitudinal edge of the spring 8 comprising a spring interconnecting cross member 12. One end of each parallel leaf contact spring 10 has a C-shaped portion 14. A portion of the cross member 12, adjacent the opposite longitudinal edge of the spring 8, defines a V-shaped longitudinal portion 13 which engages with the leading edge of a PC board as it is inserted into the connector 1.

A pivot arm 16 is formed on each opposed lateral end of the boundary between the leaf springs 10 and the cross member 12. Each pivot arm 16 is disposed at an angle 90° with respect to the plane defined by the spring. A pair of recesses 18 (FIG. 2), are integrally formed in each of the first 2 and second 4 modules each to engage with and support one of the pivot arms 16 of a spring 8 to provide desired positioning and alignment of the springs 8, relative to the modules as well as a desired freedom to pivot as will be explained below. An alignment tab 20 (FIGS. 6 and 9) is provided adjacent each pivot arm 16. The alignment tabs 20 lay substantially in the plane defined by the cross-member 12 and engage alignment slots 28 provided in opposed side walls of each of the first 2 and second 4 modules. In addition, a pair of opposed locating tabs 22 are provided on a first surface of the spring 8 for captively locating the flexible circuit 40 adjacent the spring 8 to prevent undesired relative movement therebetween.

The first 2 and second 4 modules each include a central elongate protruding rib 24 (FIGS. 1 and 2) provided on an inner surface and extending between the recesses 18. The protruding ribs 24 prevent excessive deflection of the springs 8 to prevent damage due to overdeflection. If desired, one or more stop members 26 may be provided adjacent the protruding rib 24, remote from a PC board opening 34 of the unitary structure, to limit pivoting movement of the spring 8.

The protruding ribs 24 prevent excessive stress on the springs 8 as a PC board 60 is inserted into the interior cavity 39 of the connector 1. The protruding rib 24 is preferably spaced from the second surface of the spring 8 and only functions when a PC board 60 deflects the spring excessively.

The outer housing 6 (FIGS. 3–5) is designed to encompass a substantial portion of the two modules 2, 4 once they have been mated with one another in face to face mirror relationships. The front surface of the outer housing defines a central PC board opening 34. Three serially pin apertures 36 are provided on each side of the PC board opening 34. The pin apertures 36 are disposed to receive the pins 30, of the first 2 and second 4 modules so that the pins 30 are able to extend through the pin apertures 36 to be welded, fused, glued, or otherwise secured to the outer housing 6 to provide a unitary structure.

The PC board opening end of each of the first and second modules 2, 4 defines three elongate longitudinally extending pins 30. The opposite end of each of the first and second modules 2, 4 defines a pair of guide pins 32 which engage an intermediate edge portion of the flexible circuit 40 (e.g. at guide opening 56) to locate and align that portion of the flexible circuit relative to the associated module 2 or 4.

The PC board opening 34 has a chamfered entrance 38 to guide a PC board therethrough. Once the outer housing 6 is interconnected with the two modules 2, 4, the PC board opening 34 leads to an interior cavity 39 to receive and accurately register an edge connector portion of a circuit board (see FIG. 10) for connection of contact pads thereof to the contact areas of the connector.

The unitary structure supports two, flexible circuits 40 (FIG. 8) each of which include parallel conductors 42 having contact areas 44 in an edge connector contacting region 46. Between the contacting area 44 and free end 48 of each of the flexible circuits 40 is an end region 50 which is excluded from contact with an edge connector portion of a printing circuit, to which connector 1 may be attached. The end region 50 defines three openings 52, consistent with the spacing of the engaging pins 30.

An intermediate region 54 of the flexible circuit 40, located remote from the free end 48 beyond the contact areas 44 of the flexible circuit, defines two guide openings 56 which engage the guide pins 32, of the first 2 and second 4 modules, to align the first 2 or second 4 modules with the flexible circuit 40. It will be appreciated that the guide openings 56 could be replaced, for example, by rectangular holes or circular edge cut-outs 56′ (FIG. 1) as long as the electrical continuity of the parallel conductors 42 is not jeopardized.

As illustrated, the openings 52 pass not only through the dielectric support of the flexible circuit 40 but also through portions of the conductive elements of that flexible circuit. As the openings 52 are closely adjacent the free end 48 of the flexible circuit 40, such interference with the conductive elements does not effect the electrical function of the flexible circuit 40. However, this arrangement does permit the openings 52 to be somewhat larger than could be the case if interference with the conductive elements were to be avoided.

While the conductor described in the embodiment of the invention is shown to utilize, for example, twenty (20) parallel conductors 42 have contact areas, it will be appreciated that the number of such conductors as well as the center-to-center spacing, of the conductors, may vary from application to application. For example, the center-to-center spacing of the conductors may be as small as 0.3 mm (0.012 inches) or less.

During assembly, a spring 8 is supported by its two pivot arms 16 in the pivot arm recesses 18 of each of the two modules 2 or 4 with the associated openings 52 and 56 of the flexible circuit 40 engaging the pins 30 and 32, respectively, so that these components adopt the position shown in FIG. 10 with the conductive contact areas 44 of the flexible circuits 40 facing outwardly, whereby the modules are disposed face to face, the contact areas 44 face into interior cavity 39 and are exposed to the PC board opening 34 of the connector 1. Only the contact areas 44 in the edge connector contacting region 14 are exposed in the PC board opening 34 with the conductors of the flexible circuits 40 in the end regions 50 being covered and protected by the outer housing 6 and the modules 2, 4. The sidewall portions 25 of the modules 2, 4 along with the PC board opening 34 serve to guide the edge connector portion of a circuit board 60 as it enters the connector 1 thereby facilitating accurate alignment of the edge connector portion with the unitary structure of the connector 1. Because of the accurate alignment of the springs 8 and flexible circuits 40 with that unitary structure, the contact pads 64 of the edge connector portion are accurately aligned with the contact areas 44 of the flexible circuits 40. Accurate positioning of the contact areas 44 in the connector is assured, in part, by the engagement of the openings 52 and 56 with the associated pins 30 and 32.

The extension of the flexible circuits 40 remote from the free end 48, pass through an opening defined by and between the mating first 2 and second 4 modules adjacent the end of the connector 1 remote from the PC board opening 34, for connection to other components or circuit boards, connectors, etc., as desired. The guide pins 32 (e.g. FIG. 10) are located to engage the outer edges of the outer conductors of the flexible circuit boards thereby to provide the primary means for aligning the flexible circuit contact areas with the inner modules and thus with the conductive areas 64 of an edge connector portion extending into the interior cavity 39.

The first and second modules together form a unit, with the springs 8 and flexible circuits 40 mounted and aligned therein. During final assembly of a connector 1, the outer housing 6 is secured in position around the two mating modules. Thereafter, the pins 30 are secured (e.g. welded W) to the pin apertures 36 so that the free-end 48 of each flexible circuit 40 is permanently clamped between the outer housing 6 and the associated module 2 or 4.

Figure 1:
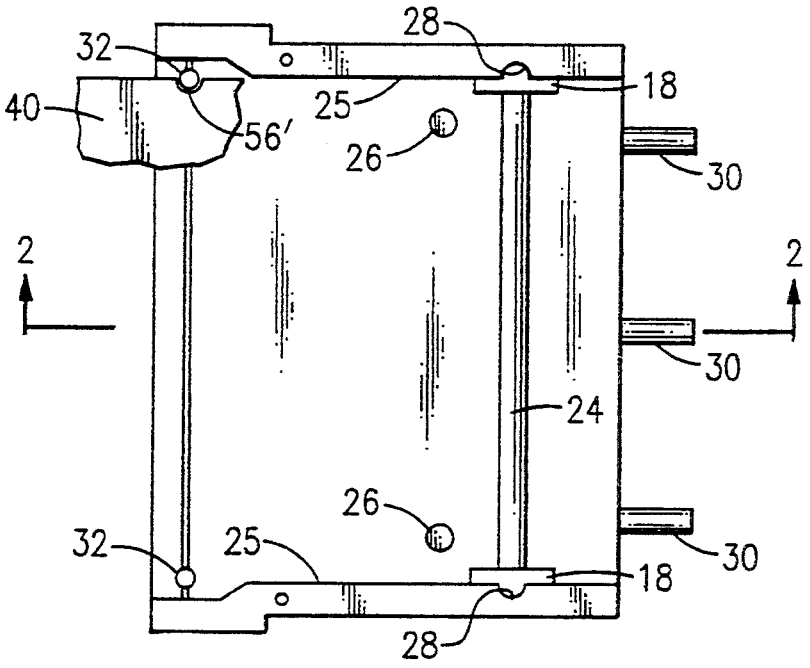
FIG. 1 is a diagrammatic plan of one of two mating modules of the present invention.
Figure 9:
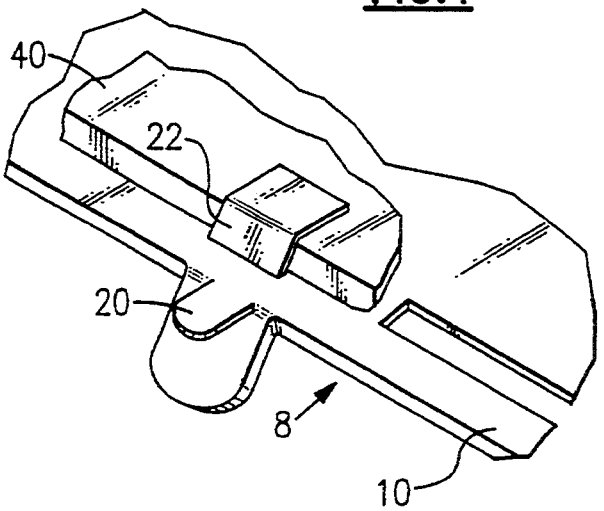
FIG. 9 is a fragmentary diagrammatic view showing a second embodiment of the spring of the present invention in combination with a flexible circuit.
Figure 2:
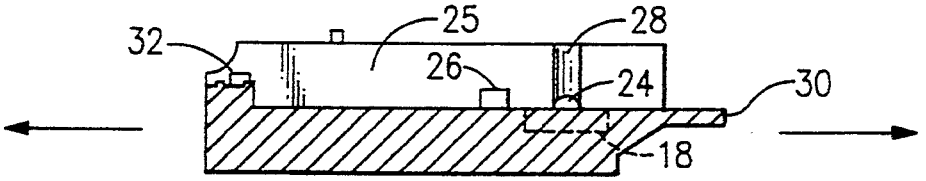
FIG. 2 is a diagrammatic cross-sectional view, along section line 2—2 of the module of FIG. 1.
Figure 6:
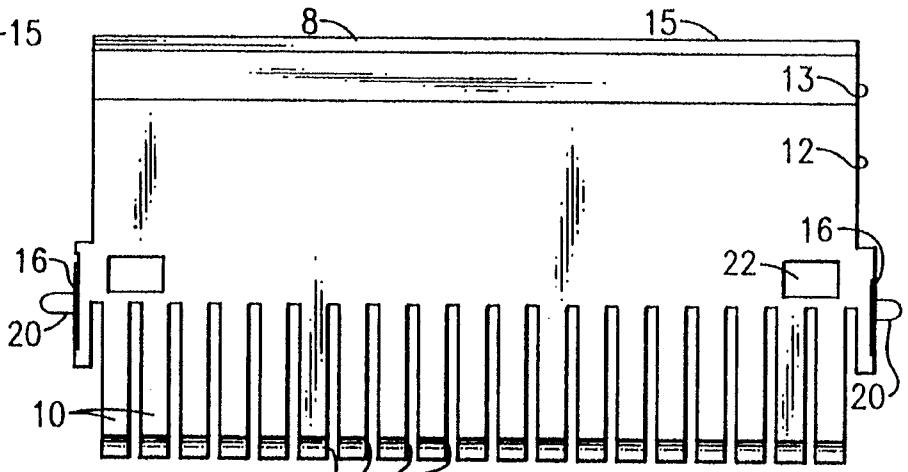
FIG. 6 is a diagrammatic plan of one embodiment of a pivotable spring which is supported by one of the two mating modules.
Figure 7:
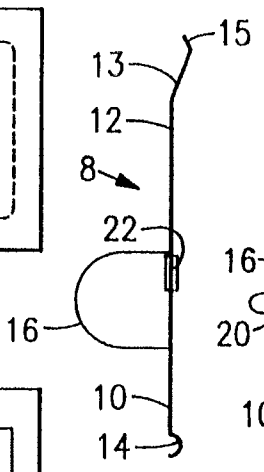
FIG. 7 is a diagrammatic right end elevation of the spring shown in FIG. 6.
Figure 8:
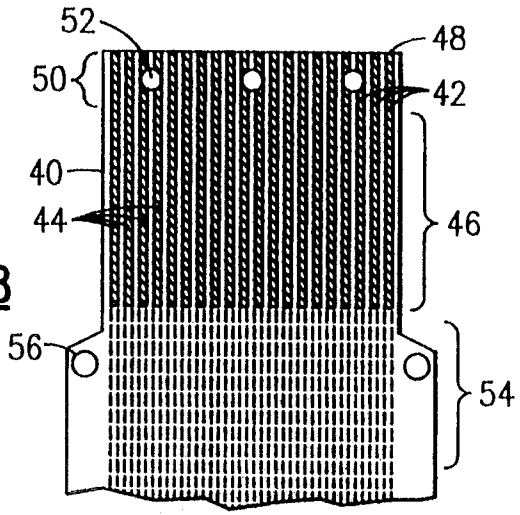
FIG. 8 is a diagrammatic plan of a flexible circuit to be accommodated by the connector of the present invention.
Figure 3:
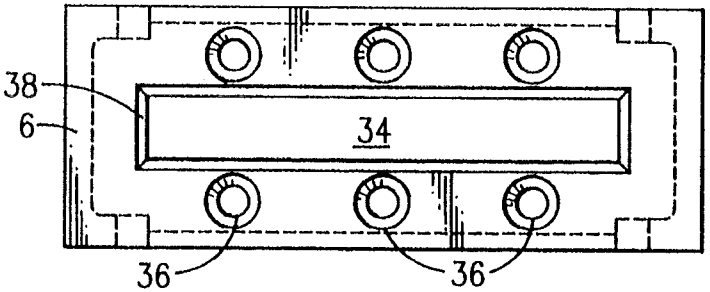
FIG. 3 is a diagrammatic front elevation of an outer housing for connecting the two mating modules with one another.
Figure 4:
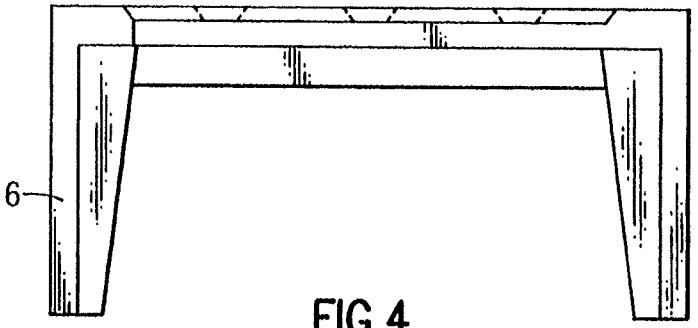
FIG. 4 is a diagrammatic underview of the outer housing shown in FIG. 3.
Figure 5:
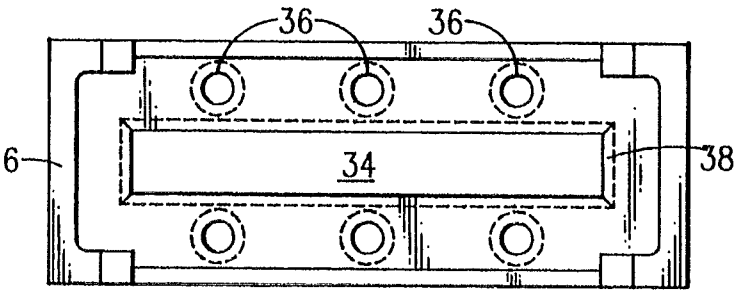
FIG. 5 is a diagrammatic rear elevation of the outer housing shown in FIG. 3.
Figure 11:
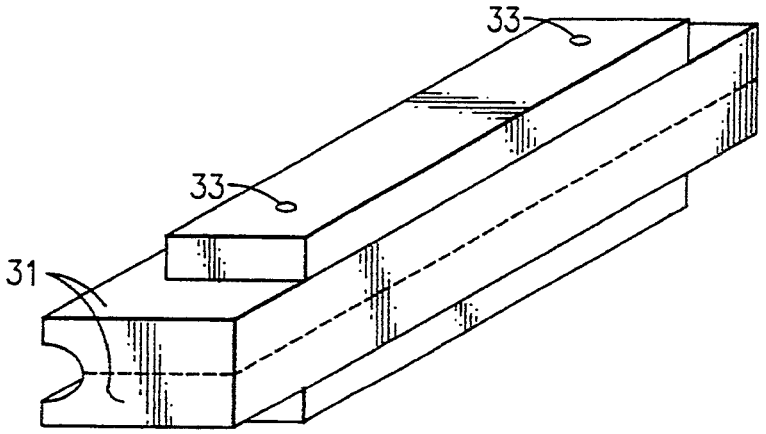
FIG. 11 is a diagrammatic perspective view of a clamp for clamping the second end of the flexible circuit to one end of the module.

After the flexible circuit 40 is attached to a first surface of the spring 8, via the clamping tabs 22, and the spring is pivotally supported to one of the first and second modules 2, 4, via engagement between the pivoting arms 16 and the pivot arm supports 18, an elongate spacer 31 can be used to ensure that the intermediate portion of the flexible circuit 40 does not become disengaged from the guide pins 32 of the modules 2, 4. The spacer 31 is provided with a plurality of recesses 33 which are spaced to engage the guide pins 32. The spacer 31 is used to clamp the flexible circuit 40 to the module 2 or 4 and prevent the flexible circuit from becoming disengaged from the guide pins 32. It is to be appreciated that a single spacer (FIG. 10), provided with a plurality of recesses 33, on opposed surfaces thereof, could be utilized in the space between the two flexible circuits 40 or two separate spacers 31 (FIG. 11), one for each module, may be utilized.

A feature of the various embodiments described in this application are their ability to protect the leading edge of the flexible circuit during insertion of an edge connector portion of a circuit board. To achieve this, the free end or leading edge of the flexible circuit 40 is trapped between the outer housing and the module 2, 4 (FIG. 10). By this arrangement contact with the leading edge of the flexible circuit in the end region 50 is avoided.

While the embodiments described illustrate the springs 8 as being mounted by pivot arms 16 received within pivot arms recesses 18, it will be appreciated by those skilled in the art that the pivot arms 16 of the springs 8 could be provided with apertures which engage pivot pins thereby facilitating pivoting movement of the spring 8 relative to the module. Various other arrangements for pivotally mounting the spring to the module would be apparent to one skilled in the art. It will be appreciated that the engagement between the alignment tabs 20 and the alignment slots 28 of the spring prevent relative movement between the spring and the module.

Figure 12:
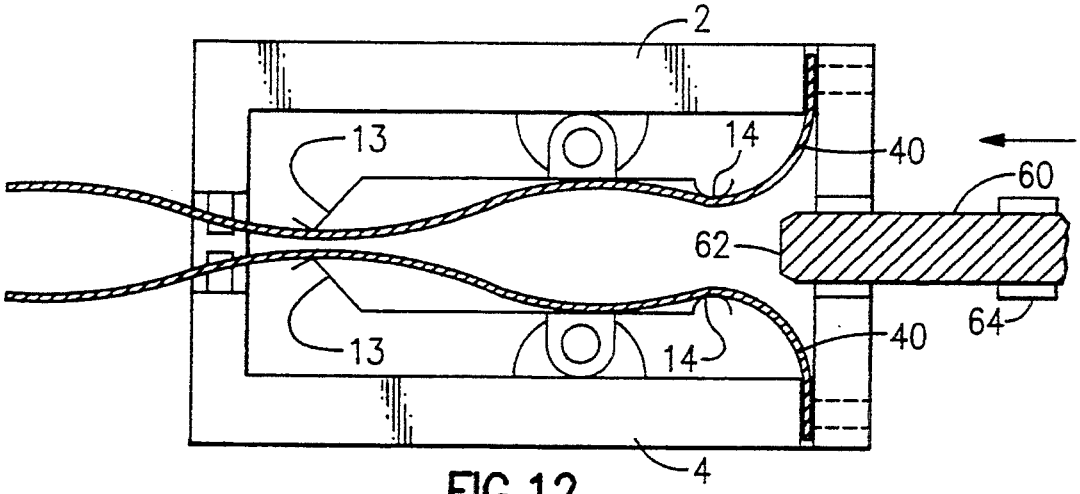
FIG. 12 diagrammatically shows a typical arrangement of the springs of the connector of the present invention prior to engagement with an edge connector portion of a desired PC board.
Figure 13:
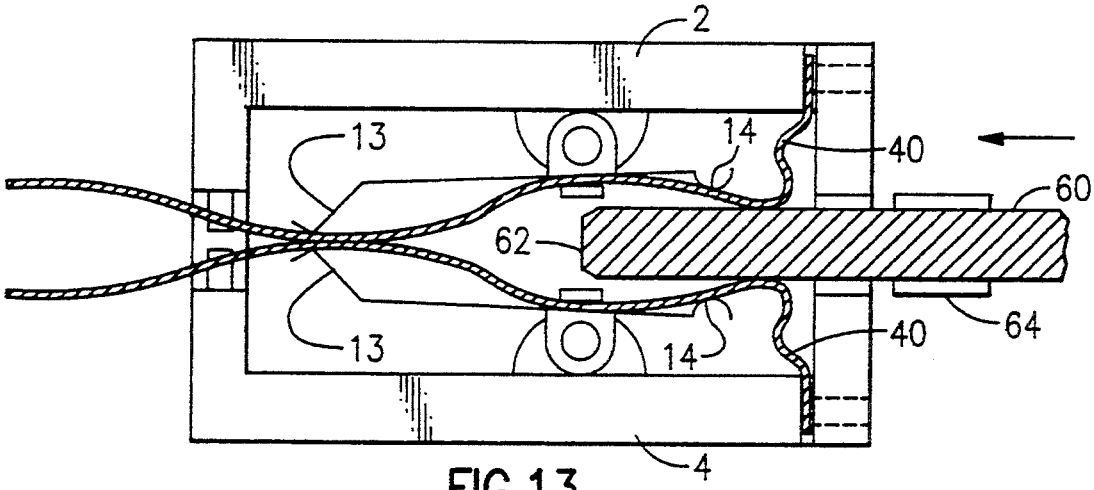
FIG. 13 diagrammatically shows partial engagement between the springs and the edge connector portion.
Figure 14:
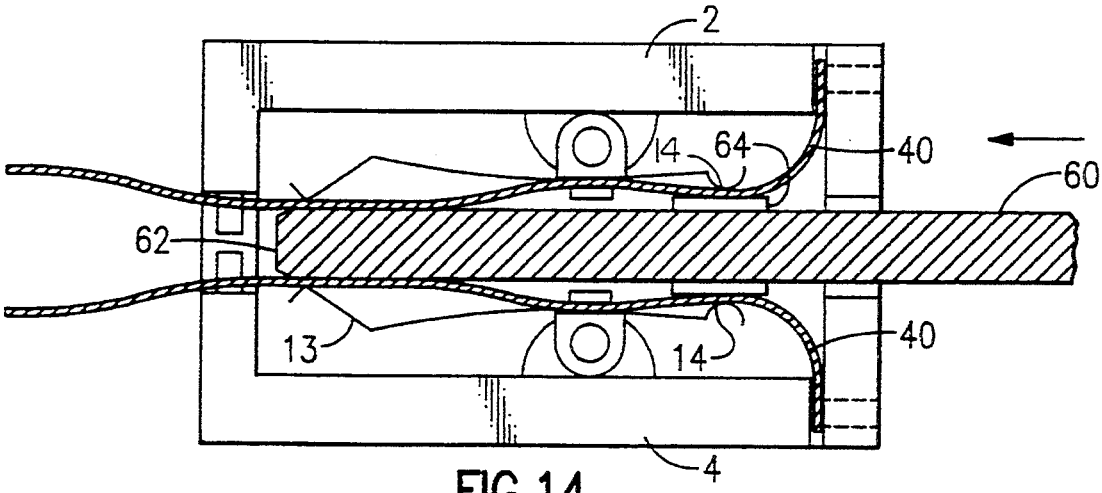
FIG. 14 diagrammatically shows full engagement between the connector and the edge connector portion.

Turning now to FIGS. 12–14, insertion of a PC board 60 into the connector 1 will now be described. As the leading edge of the PC board 60 enters the PC board opening 34 of the connector, the chamfered entrance assists with proper alignment of the PC board relative to the connector. The springs 8 are unaffected, during this initial insertion, until the PC board 60 physically contacts the flexible circuits supported thereby. Once the PC board contacts the flexible circuits, the ends of the two mating springs 8 supporting the C-shaped portions 14 are urged to pivot, about the pivot supports 18, away from one another until the V-shaped portions 13 of the cross-members 12 of each of the springs 8 bring the flexible circuits 40 supported thereby into contact with one another (FIG. 13). As a result of this pivoting movement of the springs 8, the PC board 60 experiences minimal frictional resistance with the flexible circuit and connector 1 during this stage of the insertion process. The reduced frictional resistance condition provide a light contact force between the flexible circuit and the conductive pads of a printed circuit board which is sufficient to remove any oxides or foreign material from the contact surfaces. The reduced frictional resistance condition continues until the leading edge 62 of the PC board 60 engages with the V-shaped portions 13 of the springs 8 through the flexible circuits 40 supported thereby. Once such engagement occurs, the V-shaped portions 13 of the springs 8 are moved away from one another thereby pivoting the springs to increase the contact producing force between the flexible circuit conductors adjacent the C-shaped portions and the PC board contact pads. Once the PC board 60 is fully inserted into the interior cavity 39 of the connector 1 (FIG. 14), the springs provide a sufficient biasing force of the flexible circuit against an exterior surface of the PC board to provide the desired electrical continuity between the parallel conductors 42 and the contact pads 64 of the PC board 60.

The pivoting arrangement of the springs, according to the present invention, minimizes the frictional resistance to the PC board 60 as it is being inserted into the PC board opening 34 of the connector 1 until a major portion of the PC board is inserted into the opening 34.

Although not illustrated, it will be appreciated that spring clips or other retaining elements may be mounted to the connector 1 for engagement with openings or other physical elements of an edge portion of a circuit board to retain the connector in engagement. The modular construction of the connector of the present invention allows such spring clips to be assembled in the connector ensure their captive retention in the connector.

The dielectric materials of the flexible circuit may be designed to offer selected compliance to individual conductors.

It is to be appreciated that, in the preferred embodiment of the invention, two springs, each accommodating the flexible circuit, are provided within the cavity of the housing. It is also possible to have a pair of springs with only one of said springs accommodating a flexible circuit on the first surface thereof or just one spring accommodating the flexible circuit.

The connector according the present invention prevents wear and peeling of conductive areas 44 of the flexible circuits and the contact pads 64 of the PC board 60 during insertion of the PC board 60 relative to the interconnector 1 due to the minimal frictional resistance during the initial engagement phase.

It is to be appreciated that the overall construction of the connector and support of the spring within the connector can be varied, as will be apparent to one skilled in the art. An important aspect of the present invention is that the spring is allowed to pivot to a first position, upon insertion of a PC board through the opening of the connector to minimize the friction between the PC board edge connector and the spring and/or flexible circuit accommodated within the connector. This arrangement minimizes the wear and tear on the internal components while still providing adequate electrical connection between the interconnected components.

As used herein "accommodated" shall be construed to mean "accommodated to the extent necessary to effect reliable desired electrical current carrying contact between conductor pads of an edge connector and the conductor areas of a connector in which the edge connector is so accommodated".

I claim:

1. A connector for connecting electrical conductor areas of a flexible circuit with electrical conductor pads of a connector portion of a structure, said connector comprising a connector housing having a pivot bearing, a cavity, a spring located in said cavity by said pivot bearing for pivotal movement thereabout, and a flexible circuit, defining said conductor areas, positioned in said cavity to be urged by said spring into electrical contact with said conductor pads of said connector portion when inserted into said cavity; wherein said spring defines an electrical contact producing portion and is pivotable about said pivot bearing to urge said conductor areas into electrical contact with said conductor pads when said connector portion is accommodated in said cavity and a follower portion, remote from said contact producing portion, is disposed to be engaged by said connector portion upon its insertion thereof into said cavity to urge said spring about said pivot bearing to produce said electrical contact.

2. A connector for reliably effecting desired electrically conductive contact between conductor areas of a flexible circuit with conductor pads of an edge connector portion of a circuit board, said connector comprising:

a) a connector housing defining a cavity to accommodate an edge connector portion of a desired circuit board, said housing having a first opening to allow said edge connector portion to access said cavity and a second opening to allow a flexible circuit to extend into said cavity of said connector housing; and b) spring means for resiliently biasing said electrical conductor areas into electrical contact with said conductor pads when said edge connector portion is accommodated in said cavity, said spring means being supported by and pivotal about a pivot means located in the cavity and defining an electrical contact producing portion moveable about said pivot means to urge said conductor areas into electrical contact with said conductor pads when said edge connector portion is accommodated in said cavity and a follower portion, remote from said contact producing portion and said first opening, disposed to be engaged by said edge connector portion upon insertion thereof into said cavity to urge said spring means about said pivot means to produce said electrical contact;

wherein c) said spring means is pivotable about said pivot means so that said electrical contact producing portion of said spring means can pivot away from said edge connector portion as said edge connector portion enters said cavity through said first opening, and d) in achieving accommodation of said edge connector into said connector, said follower portion of said spring means engages said edge connector portion to urge said conductor areas into said desired electrical contact with said conductor pads.

3. A connector according to claim 2 wherein as said edge connector portion enters said cavity the tendency of the spring means to pivot provides a reduced frictional engagement between the connector and said edge connector portion during a first portion of engagement therebetween.

4. A connector according to claim 2 wherein opposed cavity defining surfaces of said connector accommodate a pair of said springs means facing one another each supporting a flexible circuit defining a plurality of conductor areas with the conductor areas of each of the flexible circuits facing one another to provide electrical contact with the conductor pads of said edge connector portion when engaged therewith.

5. A connector according to claim 2 wherein said spring means has a plurality of cantilever leaf springs located adjacent a longitudinal edge of said spring means located adjacent said first opening, and a second opposite longitudinal edge of said spring has an elongate guide surface facilitating insertion and retraction of a said desired edge connector portion from the connector.

6. A connector according to claim 5 wherein said plurality of cantilever parallel leaf springs each have a C-shaped portion, located adjacent said first opening, to facilitate pivotal movement of said C-shaped portion out of a path of said edge connector portion upon insertion thereof into said connector.

7. A connector according to claim 2 wherein said spring means defines a pair of spaced pivot arms which are pivotally supported by said housing.

8. A connector according to claim 7 wherein said spring means has a pair of alignment tabs which locate said spring means in said housing and a pair of locating tabs which engage and locate said flexible circuit relative to said spring means.

9. A connector according to claim 7 wherein pivot supports are recesses formed in said interior cavity.

10. A connector according to claim 2 wherein said housing comprises first and second modules having alignment means which facilitate proper alignment of said first and second modules with one another.

11. A connector according to claim 9 wherein an elongate rib extends between said recesses.

12. A connector according to claim 10 wherein each of said first and second modules is provided with a pair of alignment slots engaging a pair of opposed alignment tabs defined by said spring means.

13. A connector according to claim 10 comprising an outer housing provided with at least two pin apertures and each of said first and second modules is provided with at least one elongate pin which extends through one of said pin apertures and is fixedly secured thereto.

14. A connector according to claim 13 wherein a free end of said flexible circuit is secured to said at least one elongate pin of one of said first and second modules and is sandwiched between said outer housing and a corresponding one of said first and second modules, during assembly of said connector, to align and secure the free end of said flexible circuit to said connector.

15. A connector according to claim 14 wherein said first and second modules each define alignment members to align a second portion of a said flexible circuit with said housing.

16. A connector for connecting electrical conductor areas of a flexible circuit with conductor pads of an edge connector portion of a circuit board, said connector comprising:

a) a connector housing having a circuit board opening sized to at least partially accommodate a said edge connector portion, and said connector housing having a circuit opening allowing passage of two flexible circuits into an interior cavity of said connector housing; and b) two springs for resiliently biasing electrical conductor areas of an edge connector contacting region of a flexible circuit into electrical contact with said conductor pads, when said connector engages a said edge connector portion, each spring being pivotably supported via a pivot support formed in opposed surfaces of said connector housing; and c) each spring supporting a flexible circuit having conductor areas facing one another to provide electrical contact with said conductor pads of an edge connector portion when engaged therewith; wherein d) said two springs are freely pivotable about said pivot supports between first and second positions in the first of which longitudinal edges of said springs located adjacent said circuit board opening pivot away from one another, as said spring is pivoted to the first position, while opposite longitudinal edges of said springs, remotely located from said circuit board opening, pivot toward one another upon insertion of said edge connector portion into the interior cavity of said connector, the springs pivot away from one another and minimize frictional resistance between the conductor areas and the conductor pads and e) as said edge connector portion is fully inserted within the interior cavity, said springs provide, in the second position, suitable electrical contact pressure between the conductor areas and conductor pads.

17. A method of manufacturing a connector for connecting electrical conductor areas of a flexible circuit with conductor pads of an edge connector portion of a circuit board, comprising the steps of:

providing a circuit board opening, sized to at least partially accommodate an edge connector portion of a desired circuit board, within a connector housing;

providing at least a second opening within said connector housing for passage of a flexible circuit into an interior cavity of said connector housing;

pivotably supporting a spring, for resiliently biasing electrical conductor areas in an edge connector contacting region of a flexible circuit, when supported therein, into electrical contact with said conductor pads when said connector is attached to a said edge connector portion, via a pivot support formed in an interior surface of said connector housing;

said spring being freely pivotable about said pivot support between first and second positions in the first of which a longitudinal edge of said spring located adjacent said circuit board opening pivots toward the interior surface of said connector housing supporting said pivot support while a second opposite longitudinal edge of said spring located remoted said circuit board opening pivots away from the interior surface of said connector housing supporting said pivot support whereby said spring, upon insertion a said edge connector portion within the interior cavity of said connector, is pivoted to the first position and minimizes frictional resistance between the connector and a said edge connector portion and said spring and, when a said edge connector portion is fully inserted within the interior cavity, provides in the second position suitable electrical contact pressure between the conductor areas and conductor pads.

* * * * *